US007398763B2

(12) United States Patent
Gibson et al.

(10) Patent No.: US 7,398,763 B2
(45) Date of Patent: Jul. 15, 2008

(54) MULTI-SOURCE FUEL SYSTEM FOR VARIABLE PRESSURE INJECTION

(75) Inventors: Dennis H. Gibson, Chillicothe, IL (US); Mark F. Sommars, Sparland, IL (US); Jinhui Sun, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 83 days.

(21) Appl. No.: 11/332,306

(22) Filed: Jan. 17, 2006

(65) Prior Publication Data

US 2007/0101968 A1 May 10, 2007

Related U.S. Application Data

(60) Provisional application No. 60/734,784, filed on Nov. 9, 2005.

(51) Int. Cl.
*F02M 63/00* (2006.01)

(52) U.S. Cl. ..... 123/447

(58) Field of Classification Search ..... 123/446, 123/447

See application file for complete search history.

(56) References Cited

U.S. PATENT DOCUMENTS

| | | | | |
|---|---|---|---|---|
| 3,000,319 | A | 9/1961 | Tuck | |
| 3,105,441 | A | 10/1963 | Grill et al. | |
| 4,083,345 | A | 4/1978 | Davis | |
| 5,094,216 | A | 3/1992 | Miyaki et al. | |
| 5,277,156 | A | 1/1994 | Osuka et al. | |
| 5,404,855 | A | 4/1995 | Yen et al. | |
| 5,433,182 | A | 7/1995 | Augustin et al. | |
| 5,441,027 | A | 8/1995 | Buchanon et al. | |
| 5,460,133 | A | 10/1995 | Perr et al. | |
| 5,592,968 | A | 1/1997 | Nakashima et al. | |
| 5,603,303 | A | 2/1997 | Okajima et al. | |
| 5,622,152 | A | 4/1997 | Ishida | |
| 5,642,714 | A * | 7/1997 | Buckley | 123/447 |
| 5,727,525 | A * | 3/1998 | Tsuzuki | 123/447 |

(Continued)

FOREIGN PATENT DOCUMENTS

DE 199 39 422 A1 3/2001

(Continued)

OTHER PUBLICATIONS

B. Mahr (Robert Bosch GmbH, Diesel Systems, DS-NF/SBN, Postfach 30 02 20, D-70469 Stuttgart, Germany), "Future and Potential of Diesel Injection Systems", THIESEL 2002 Conference on Thermo- and Fluid-Dynamic Process in Diesel Engines, Sep. 2002, pp. 5-17, Valencia, Spain.

(Continued)

*Primary Examiner*—Thomas Moulis
(74) *Attorney, Agent, or Firm*—Finnegan, Henderson, Farabow, Garrett & Dunner

(57) ABSTRACT

A fuel system for a work machine is disclosed. The fuel system has a fuel injector, a first source of fuel at a first pressure, a second source of fuel at a second pressure, and a pressure control device. The pressure control device is disposed between the fuel injector and the first and second sources. The pressure control device is configured to selectively direct the fuel at the first pressure and the fuel at the second pressure to the fuel injector.

21 Claims, 4 Drawing Sheets

U.S. PATENT DOCUMENTS

| | | | | |
|---|---|---|---|---|
| 5,732,679 | A * | 3/1998 | Takahasi et al. | 123/467 |
| 5,983,863 | A | 11/1999 | Cavanagh et al. | |
| 6,092,509 | A | 7/2000 | Tanabe et al. | |
| 6,095,118 | A | 8/2000 | Klinger et al. | |
| 6,112,721 | A | 9/2000 | Kouketsu et al. | |
| 6,253,735 | B1 | 7/2001 | Miyajima | |
| 6,311,674 | B1 | 11/2001 | Igashira et al. | |
| 6,357,421 | B1 | 3/2002 | Pritchard | |
| 6,427,660 | B1 | 8/2002 | Yang | |
| 6,491,017 | B1 | 12/2002 | Mahr et al. | |
| 6,505,608 | B2 | 1/2003 | Hiraku et al. | |
| 6,520,152 | B1 * | 2/2003 | Mahr et al. | 123/447 |
| 6,619,263 | B1 * | 9/2003 | Mahr et al. | 123/447 |
| 6,684,855 | B2 | 2/2004 | Murakami et al. | |
| 6,792,919 | B2 * | 9/2004 | Kohketsu et al. | 123/447 |
| 6,832,599 | B2 | 12/2004 | Ibrahim et al. | |
| 6,889,656 | B1 | 5/2005 | Rembold et al. | |
| 6,895,937 | B2 * | 5/2005 | Namekawa et al. | 123/447 |
| 6,899,084 | B2 | 5/2005 | Miyashita | |
| 6,973,921 | B2 | 12/2005 | Shafer et al. | |
| 7,146,963 | B2 | 12/2006 | Tahara | |
| 7,150,268 | B2 | 12/2006 | Shafer et al. | |
| 7,179,060 | B2 | 2/2007 | Sommars et al. | |
| 7,182,067 | B2 | 2/2007 | Ricco et al. | |
| 2004/0163626 | A1 | 8/2004 | Stockner et al. | |
| 2004/0168673 | A1 | 9/2004 | Shinogle | |
| 2005/0115544 | A1 | 6/2005 | Kim | |
| 2005/0126545 | A1 | 6/2005 | Shafer et al. | |
| 2007/0101968 | A1 | 5/2007 | Gibson et al. | |

FOREIGN PATENT DOCUMENTS

| | | | |
|---|---|---|---|
| DE | 199 45 673 | A1 | 5/2001 |
| EP | 0 643 221 | A1 | 3/1995 |
| EP | 1 273 797 | A2 | 1/2003 |
| EP | 1389680 | A2 | 2/2004 |
| EP | 1 522 719 | A1 | 4/2005 |
| JP | 6-93936 | | 5/1994 |
| WO | WO 01/24320 | A1 | 4/2001 |
| WO | WO 2007/055805 | | 5/2007 |

OTHER PUBLICATIONS

Research Disclosure, Nov. 2004, No. 487, www.researchdisclosure.com, Kenneth Mason Publications Ltd.; Westbourne, Hampshire, UK.

PCT International Search Report, PCT/US2006/036727; Filing Date: Sep. 20, 2006; Applicant: Caterpillar Inc., Date of Mailing: Jan. 22, 2007.

PCT International Search Report for PCT/US2007/012029 mailed Dec. 7, 2007.

* cited by examiner

MULTI-SOURCE FUEL SYSTEM FOR VARIABLE PRESSURE INJECTION

RELATED APPLICATIONS

This application is based on and claims the benefit of priority from U.S. Provisional Application No. 60/734,784 by Dennis H. GIBSON, Jinhui SUN, and Mark F. SOMMARS, filed Nov. 9, 2005, the contents of which are expressly incorporated herein by reference.

TECHNICAL FIELD

The present disclosure is directed to a fuel system and, more particularly, to a fuel system having multiple sources of pressurized fuel for providing variable pressure injection events.

BACKGROUND

Common rail fuel systems provide a way to introduce fuel into the combustion chambers of an engine. Typical common rail fuel systems include an injector having an actuating solenoid that opens a fuel nozzle when the solenoid is energized. Fuel is then injected into the combustion chamber as a function of the time period during which the solenoid remains energized and the pressure of fuel supplied to the fuel injector nozzle during that time period.

To optimize engine performance and exhaust emissions, engine manufacturers may vary the pressure of the fuel supplied to the fuel injector nozzle. One such example is described in U.S. Patent Application Publication No. 2004/0168673 (the '673 publication) by Shinogle published Sep. 2, 2004. The '673 publication describes a fuel system having a fuel injector fluidly connectable to a first common rail holding a supply of fuel, and a second common rail holding a supply of actuation fluid. Each fuel injector of the '673 patent is equipped with an intensifier piston movable by the actuation fluid to increase the pressure of the fuel. By fluidly connecting the fuel injector to the first common rail, fuel can be injected at a first pressure. By fluidly connecting the fuel injector to the first and second common rails, fuel can be injected at a second pressure that is higher than the first pressure.

Although the fuel injection system of the '673 publication may adequately supply fuel to an engine at different pressures, it may, however, have limitations. Specifically, because the second pressure is achieved by intensifying the first pressure, the second pressure is dependent on the first pressure. This dependency may limit the ability to shape the rate of fuel injections with the system of the '673 publication. In addition, the intensifier component within each fuel injector may increase the complexity of the fuel injector and the associated overall system cost.

The fuel system of the present disclosure solves one or more of the problems set forth above.

SUMMARY OF THE INVENTION

One aspect of the present disclosure is directed to a fuel system for an engine having at least one combustion chamber. The fuel system includes a fuel injector, a first source of fuel at a first pressure, a second source of fuel at a second pressure, and a pressure control device. The pressure control device is disposed between the fuel injector and the first and second sources. The pressure control device is configured to selectively direct the fuel at the first pressure and the fuel at the second pressure to the fuel injector for injection into the at least one combustion chamber.

Another aspect of the present disclosure is directed to a method of injecting fuel into a combustion chamber of an engine. The method includes pressurizing fuel to a first pressure and pressurizing fuel to a second pressure. The method also includes selectively directing fuel at the first pressure and fuel at the second pressure to a fuel injector for injection into the combustion chamber.

DETAILED DESCRIPTION

Figure 1:
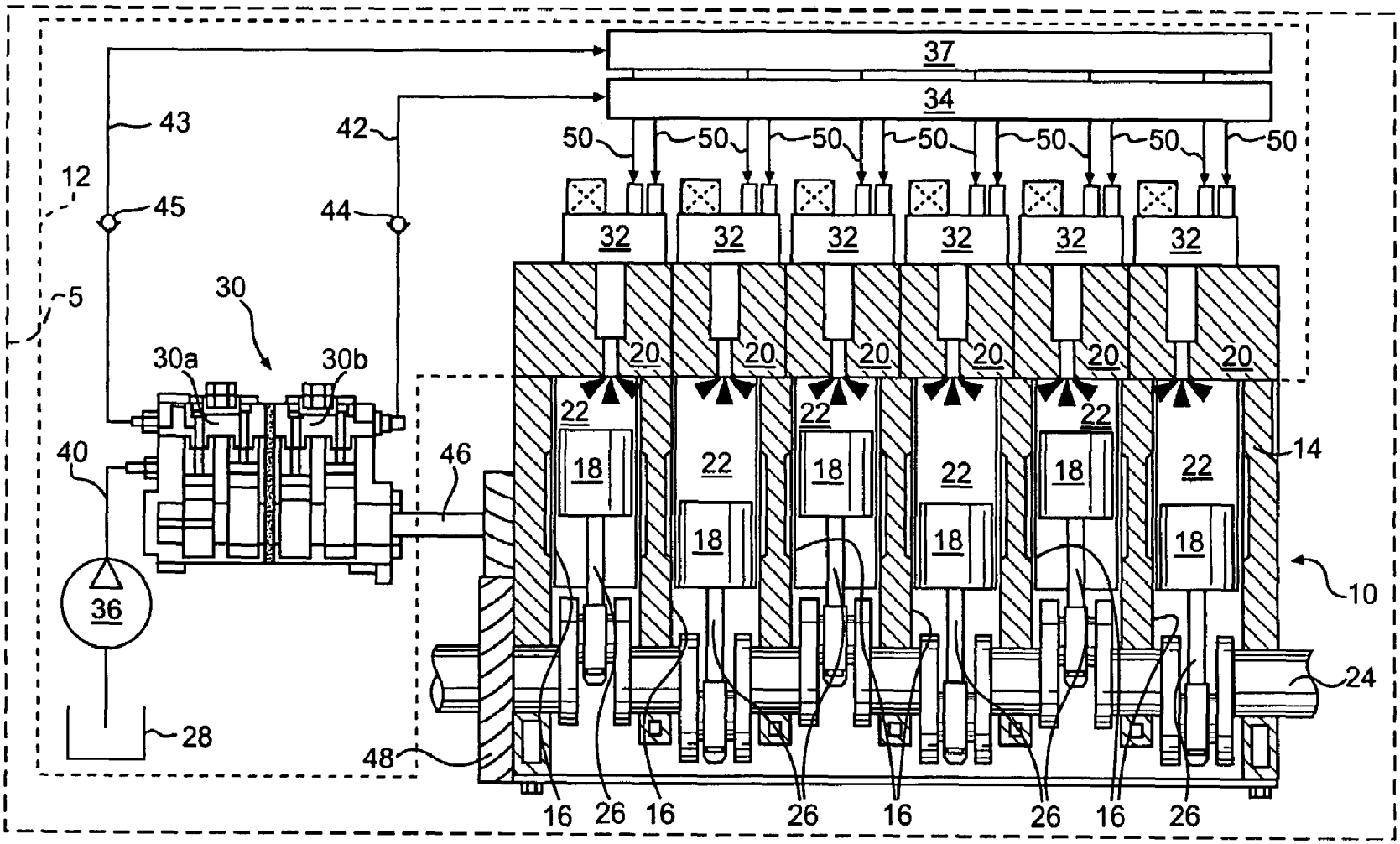
FIG. 1 is a schematic and diagrammatic illustration of an exemplary disclosed engine.

FIG. 1 illustrates a work machine 5 having an engine 10 and an exemplary embodiment of a fuel system 12. Work machine 5 may be a fixed or mobile machine that performs some type of operation associated with an industry such as mining, construction, farming, power generation, transportation, or any other industry known in the art. For example, work machine 5 may embody an earth moving machine, a generator set, a pump, or any other suitable operation-performing work machine.

For the purposes of this disclosure, engine 10 is depicted and described as a four-stroke diesel engine. One skilled in the art will recognize, however, that engine 10 may embody any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, and a fuel pumping arrangement 30 configured to pressurize the fuel and direct one or more streams of pressurized fuel to a plurality of fuel injectors 32. A fuel transfer pump 36 may be disposed within a fuel line 40 between the tank 28 and the fuel pumping arrangement 30 and configured to provide low pressure feed to fuel pumping arrangement 30.

Fuel pumping arrangement 30 may embody a mechanically driven, electronically controlled unit injector pump having a first pumping mechanism 30*a* and a second pumping mechanism 30*b*. Each of first and second pumping mechanisms 30*a, b* may be operatively connected to a pump drive shaft 46 by way of rotatable cams (not shown). The cams may be adapted to drive piston elements (not shown) of first and second pumping mechanisms 30*a, b* through a compression stroke to pressurize fuel. Plungers (not shown) associated with first and second pumping mechanisms 30*a, b* may be closed at variable timings to change the length of the compression stroke and thereby vary the flow rate of first and second pumping mechanisms 30*a, b*. Alternatively, first and second pumping mechanisms 30*a, b* may include a rotatable swashplate, or any other means known in the art for varying the flow rate of pressurized fuel.

First and second pumping mechanisms 30*a, b* may be adapted to generate separate flows of pressurized fuel. For example, first pumping mechanism 30*a* may generate a first flow of pressurized fuel directed to a first common rail 34 by way of a first fuel supply line 42. Second pumping mechanism 30*b* may generate a second flow of pressurized fuel directed to a second common rail 37 by way of a second fuel supply line 43. In one example, the first flow of pressurized fuel may have a pressure of about 100 MPa, while the second flow of pressurized fuel may have a pressure of about 200 MPa. A first check valve 44 may be disposed within first fuel supply line 42 to provide for unidirectional flow of fuel from first pumping mechanism 30*a* to first common rail 34. A second check valve 45 may be disposed within second fuel supply line 43 to provide for unidirectional flow of fuel from second pumping mechanism 30*b* to second common rail 37.

Fuel pumping arrangement 30 may be operatively connected to engine 10 and driven by crankshaft 24. For example, pump driveshaft 46 of fuel pumping arrangement 30 is shown in FIG. 1 as being connected to crankshaft 24 through a gear train 48. It is contemplated, however, that one or both of first and second pumping mechanisms 30*a, b* may alternatively be driven electrically, hydraulically, pneumatically, or in any other appropriate manner.

Fuel injectors 32 may be disposed within cylinder heads 20 and connected to first and second common rails 34, 37 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center (TDC) position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Figure 2:
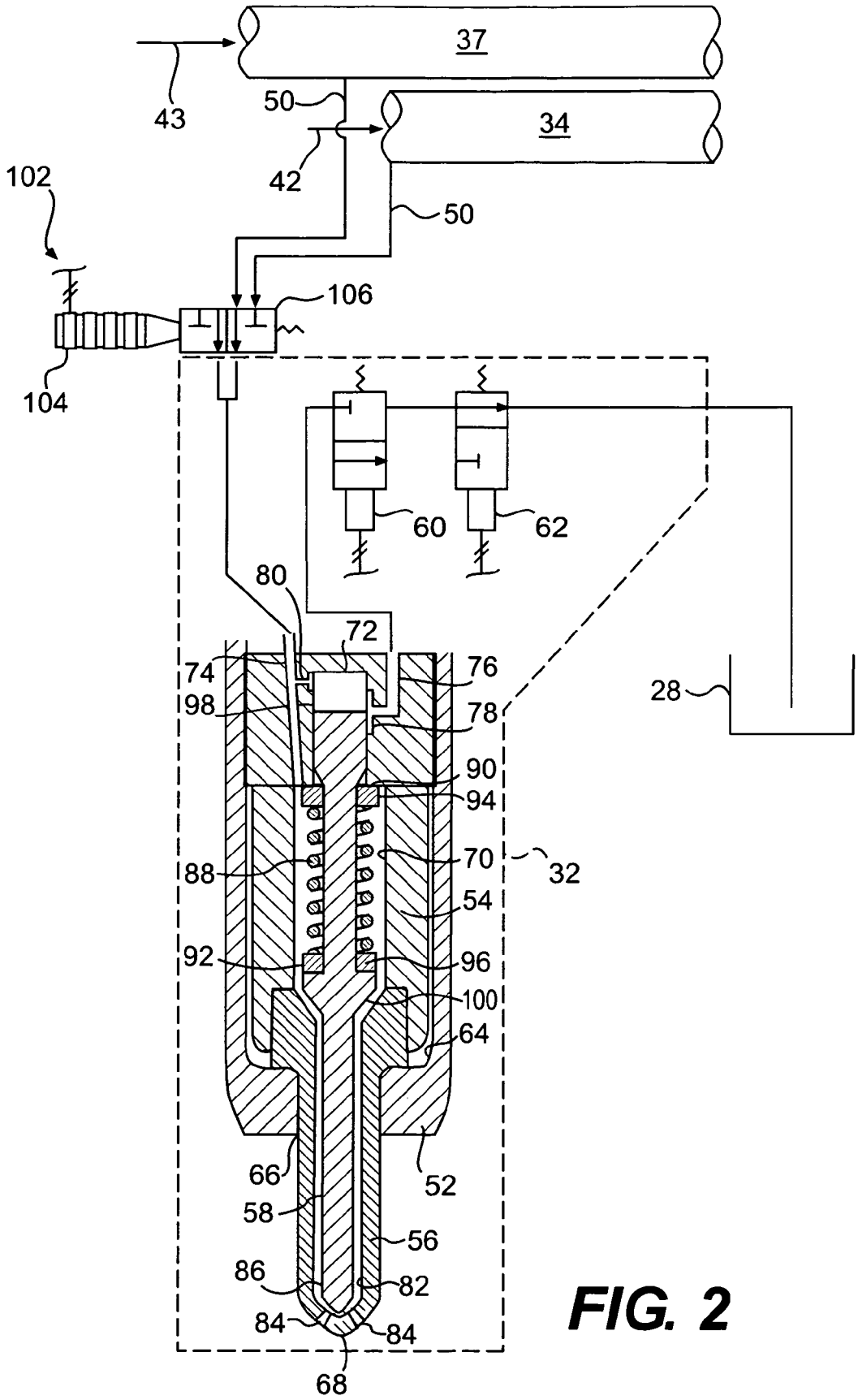
FIG. 2 is a schematic and cross-sectional illustration of an exemplary disclosed fuel system for the engine of FIG. 1.

As illustrated in FIG. 2, each fuel injector 32 may embody a closed nozzle unit fuel injector. Specifically, each fuel injector 32 may include an injector body 52 housing a guide 54, a nozzle member 56, a needle valve element 58, a first solenoid actuator 60, and a second solenoid actuator 62.

Injector body 52 may be a generally cylindrical member configured for assembly within cylinder head 20. Injector body 52 may have a central bore 64 for receiving guide 54 and nozzle member 56, and an opening 66 through which a tip end 68 of nozzle member 56 may protrude. A sealing member such as, for example, an o-ring (not shown) may be disposed between guide 54 and nozzle member 56 to restrict fuel leakage from fuel injector 32.

Guide 54 may also be a generally cylindrical member having a central bore 70 configured to receive needle valve element 58, and a control chamber 72. Central bore 70 may act as a pressure chamber, holding pressurized fuel continuously supplied by way of a fuel supply passageway 74. During injection, the pressurized fuel from fuel line 50 may flow through fuel supply passageway 74 and central bore 70 to the tip end 68 of nozzle member 56.

Control chamber 72 may be selectively drained of or supplied with pressurized fuel to control motion of needle valve element 58. Specifically, a control passageway 76 may fluidly connect a port 78 associated with control chamber 72, and first solenoid actuator 60. Port 78 may be disposed within a side wall of control chamber 72 that is radially oriented relative to axial movement of needle valve element 58 or, alternatively, within an axial end portion of control chamber 72. Control chamber 72 may be continuously supplied with pressurized fuel via a restricted supply passageway 80 that is in communication with fuel supply passageway 74. The restriction of supply passageway 80 may allow for a pressure drop within control chamber 72 when control passageway 76 is drained of pressurized fuel.

Nozzle member 56 may likewise embody a generally cylindrical member having a central bore 82 that is configured to receive needle valve element 58. Nozzle member 56 may further include one or more orifices 84 to allow injection of the pressurized fuel from central bore 82 into combustion chambers 22 of engine 10.

Needle valve element 58 may be a generally elongated cylindrical member that is slidingly disposed within housing guide 54 and nozzle member 56. Needle valve element 58 may be axially movable between a first position at which a tip end 86 of needle valve element 58 blocks a flow of fuel through orifices 84, and a second position at which orifices 84 are open to allow a flow of pressurized fuel into combustion chamber 22.

Needle valve element 58 may be normally biased toward the first position. In particular, each fuel injector 32 may include a spring 88 disposed between a stop 90 of guide 54 and a seating surface 92 of needle valve element 58 to axially bias tip end 86 toward the orifice-blocking position. A first spacer 94 may be disposed between spring 88 and stop 90, and a second spacer 96 may be disposed between spring 88 and seating surface 92 to reduce wear of the components within fuel injector 32.

Needle valve element 58 may have multiple driving hydraulic surfaces. In particular, needle valve element 58 may include a hydraulic surface 98 tending to drive needle valve element 58 toward the first or orifice-blocking position when acted upon by pressurized fuel, and a hydraulic surface 100 that tends to oppose the bias of spring 88 and drive needle valve element 58 in the opposite direction toward the second or orifice-opening position.

First solenoid actuator 60 may be disposed opposite tip end 86 of needle valve element 58 to control the opening motion of needle valve element 58. In particular, first solenoid actuator 60 may include a two-position valve element disposed between control chamber 72 and tank 28. The valve element may be spring-biased toward a closed position blocking fluid flow from control chamber 72 to tank 28, and solenoid-actuated toward an open position at which fuel is allowed to flow from control chamber 72 to tank 28. The valve element may be movable between the closed and open positions in response to an electric current applied to a coil associated with first solenoid actuator 60. It is contemplated that the valve element may alternatively be hydraulically operated, mechanically operated, pneumatically operated, or operated in any other suitable manner. It is further contemplated that the valve element may alternatively embody a proportional type of valve element that is movable to any position between the closed and open positions.

Second solenoid actuator 62 may include a two-position valve element disposed between first solenoid actuator 60 and tank 28 to control a closing motion of needle valve element 58. The valve element may be spring-biased toward an open position at which fuel is allowed to flow to tank 28, and solenoid-actuated toward a closed position blocking fluid flow to tank 28. The valve element may be movable between the open and closed positions in response to an electric current applied to a coil associated with second solenoid actuator 62. It is contemplated that the valve element may alternatively be hydraulically operated, mechanically operated, pneumatically operated, or operated in any other suitable manner. It is further contemplated that the valve element may alternatively embody a three-position type of valve element, wherein bidirectional flows of pressurized fuel are facilitated.

As also illustrated in FIG. 2, a pressure control device 102 may be associated with each fuel injector 32. Specifically, pressure control device 102 may include an actuator 104 operatively connected to a valve element 106. Valve element 106 may be disposed between first and second common rails 34, 37 and fuel injector 32, and movable by actuator 104 to selectively combine the first and second flows of pressurized fuel.

Actuator 104 may embody a piezo electric mechanism having one or more columns of piezo electric crystals. Piezo electric crystals are structures with random domain orientations. These random orientations are asymmetric arrangements of positive and negative ions that exhibit permanent dipole behavior. When an electric field is applied to the crystals, such as, for example, by the application of a current, the piezo electric crystals expand along the axis of the electric field as the domains line up. It is contemplated that actuator 104 may be part of fuel injector 32 or a separate stand-alone component associated with one or more fuel injectors 32.

Actuator 104 may be connected to mechanically control the motion of valve element 106. For example, as a current is applied to the piezo electric crystals of actuator 104, actuator 104 may expand to move valve element 106 to increase the pressure of the fluid flowing to fuel injector 32. In contrast, as the current is removed from the piezo electric crystals of actuator 104, actuator 104 may contract to move valve element 106 to reduce the pressure of fuel flowing to fuel injector 32. It is contemplated that the piezo electric crystals of actuator 104 may be omitted, if desired, and the movement of valve element 106 be controlled in another suitable manner.

Valve element 106 may embody a proportional valve element or other suitable device movable by actuator 104 to selectively combine the first and second flows of pressurized fuel from first and second common rails 34, 47 directed to central bore 82 of nozzle member 56. Specifically, valve element 10 may be movable between a first position at which only the first stream of pressurized fuel is directed to central bore 82, and a second position at which only the second stream of pressurized fuel is directed to central bore 82. Valve element 106 may also be movable to any position between the first and second positions to direct a portion of the first and second pressurized flows of fuel to central bore 82. The amount and ratio of the first or second flows directed by valve element 106 to central bore 82 may be dependent on the current applied to the piezo electric crystals of actuator 104 and may affect the pressure of the fuel supplied to central bore 82. This combining of pressurized fuel may allow for a variable pressure of fuel with central bore 82, resulting in a variable injection rate of fuel through orifices 84 and penetration depth into combustion chamber 22.

Figure 3:
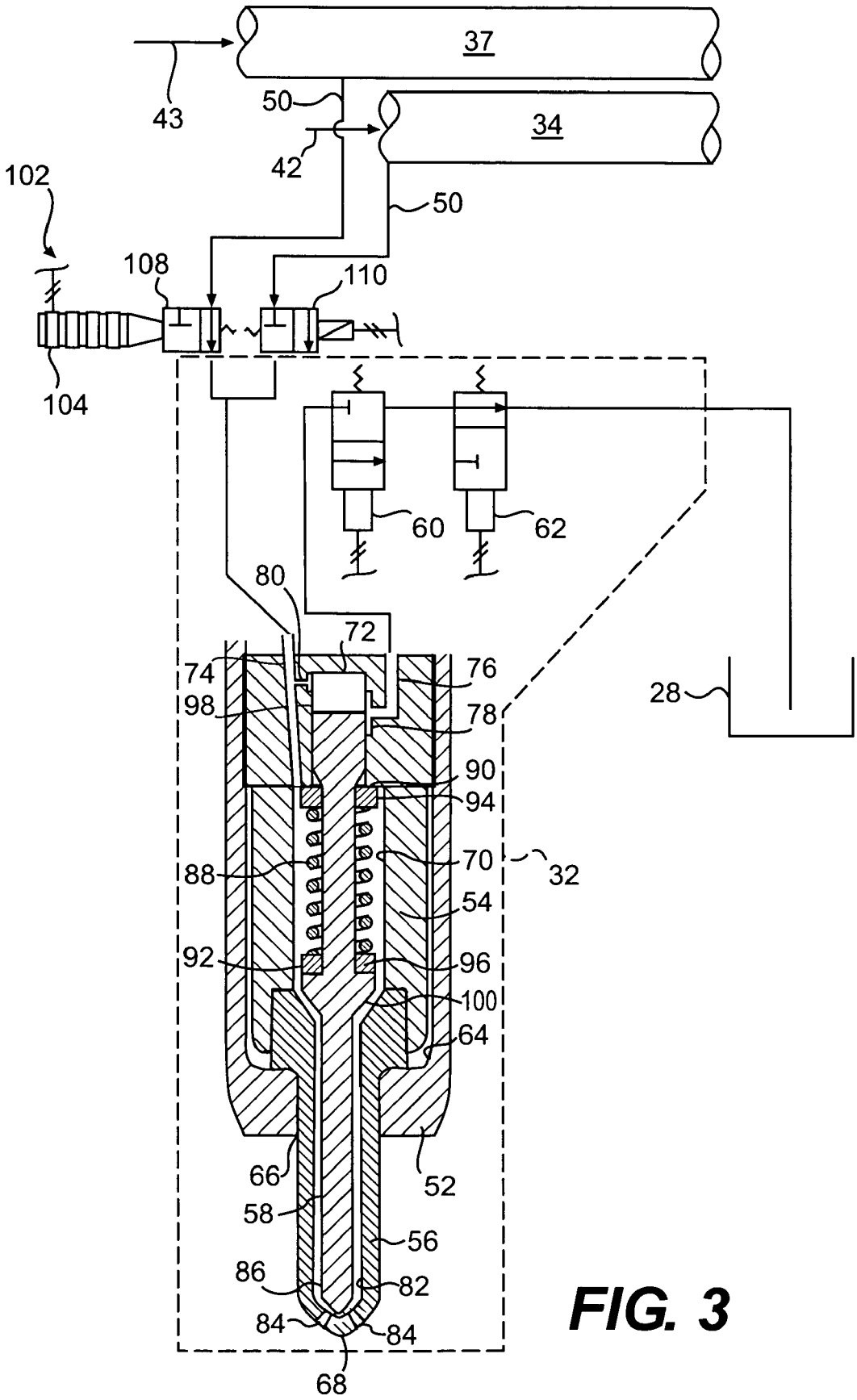
FIG. 3 is a schematic and cross-sectional illustration of another exemplary disclosed fuel system for the engine of FIG. 1.

FIG. 3 illustrates an alternate embodiment to fuel system 12 of FIG. 2. Similar to fuel system 12 of FIG. 2, fuel system 12 of FIG. 3 includes a fuel injector 32 receiving combinable flows of pressurized fuel from first and second common rails 34 and 37 via fuel lines 50 and actuator 104. However, in contrast to the single valve element 106 of actuator 104 depicted in FIG. 2, actuator 104 of FIG. 3 includes two separate valve elements 108 and 110.

During an injection event when the first and second flows of pressurized fuel are combined via valve element 106 (referring to FIG. 2), it is possible for the higher pressure fuel from second common rail 37 to flow in reverse direction into first common rail 34. This reverse flow can reduce the efficiency of fuel system 12. To improve the efficiency of fuel system 12, actuator 104 of FIG. 3 may implement separate valve elements 108 and 110.

Similar to valve element 106, valve element 108 may embody a proportional valve element or other suitable device movable by actuator 104. Valve element 108 may be movable between a first position at which pressurized fuel from second common rail 37 is blocked from fuel injector 32, and a second position at which a maximum amount of fuel from second common rail 37 is directed to fuel injector 32. Valve element 108 may also be movable to any position between the first and second positions to direct a portion of the second pressurized flow of fuel to fuel injector 2. The amount of the second flow of pressurized fuel from second common rail 37 directed by valve element 108 to fuel injector 32 may correspond to the current applied to the piezo electric crystals of actuator 104.

In contrast to valve element 108, valve element 110 may embody a two-position, solenoid-actuated valve element. Valve element 110 may be movable from a first position at which substantially no pressurized fuel from first common rail 34 is directed to central bore 82, to a second position at a maximum amount of fuel from the first common rail 34 is directed to fuel injector 32. Valve elements 108 and 110 may be separately or simultaneously operated to independently direct pressurized fuel from either the first common rail 34, the second common rail 37, or both of the first and second common rails 34, 37. This combining of pressurized fuel from first and second common rails 34, 37 may allow for a variable pressure of fuel with central bore 82, resulting in a variable injection rate of fuel through orifices 84 and penetration depth into combustion chamber 22.

Figure 4:
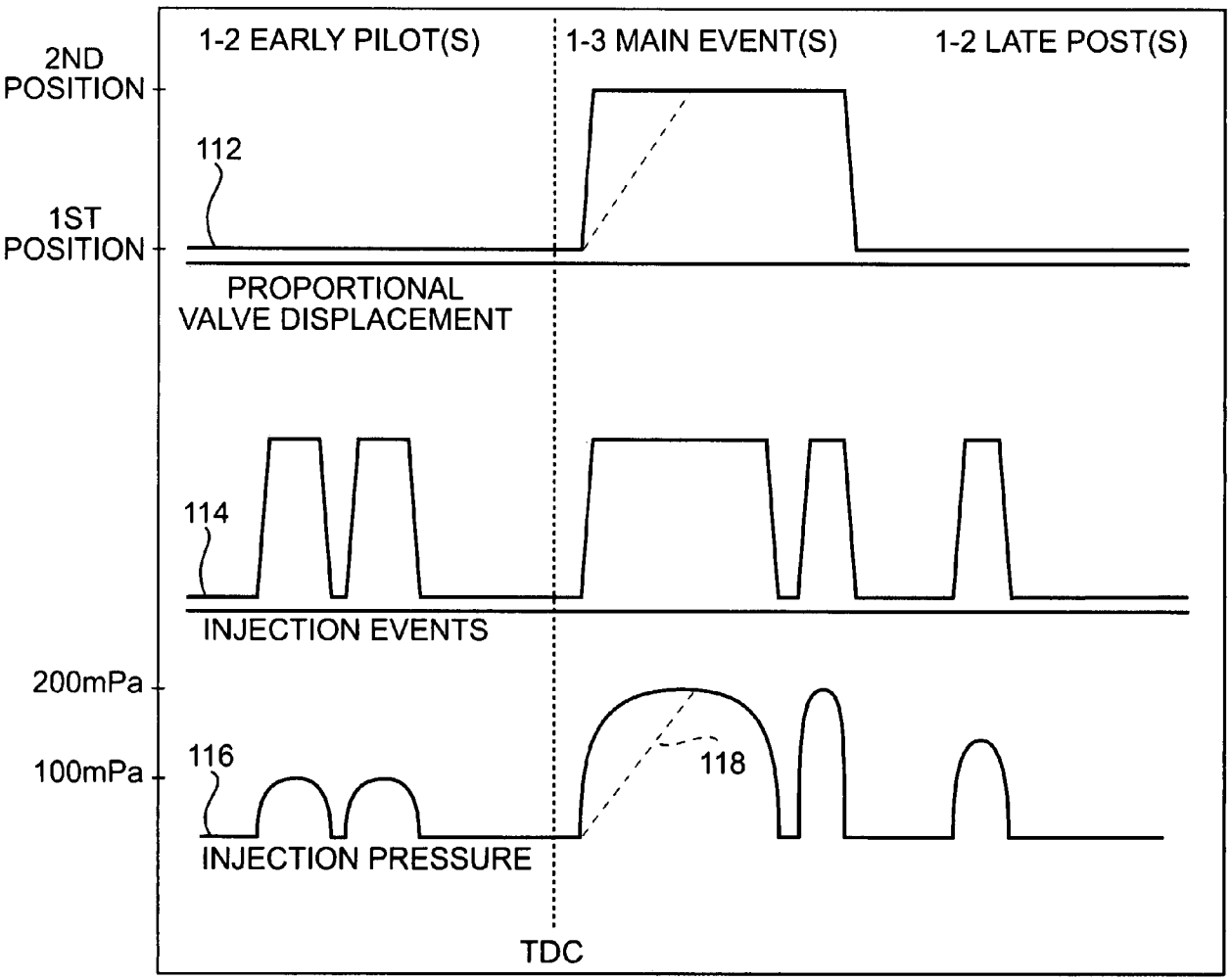
FIG. 4 is a graph depicting an exemplary operation of the fuel systems of FIGS. 2 and 3.

FIG. 4 illustrates an exemplary operation of fuel system 12. FIG. 4 will be discussed in the following section to further illustrate the disclosed system and its operation.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine that utilizes a pressurizing fuel system wherein it may be advantageous to provide a variable pressure supply of fuel. The operation of fuel system 12 will now be explained.

Needle valve element 58 may be moved by an imbalance of force generated by fuel pressure. For example, when needle valve element 58 is in the first or orifice-blocking position, pressurized fuel from fuel supply passageway 74 may flow into control chamber 72 to act on hydraulic surface 98. Simultaneously, pressurized fuel from fuel supply passageway 74 may flow into central bores 70 and 82 in anticipation of injection. The force of spring 88 combined with the hydraulic force generated at hydraulic surface 98 may be greater than an opposing force generated at hydraulic surface 100 thereby causing needle valve element 58 to remain in the first position to restrict fuel flow through orifices 84. To open orifices 84 and inject the pressurized fuel from central bore 82 into combustion chamber 22, first solenoid actuator 60 may move its associated valve element to selectively drain the pressurized fuel away from control chamber 72 and hydraulic surface 98. This decrease in pressure acting on hydraulic surface 98 may allow the opposing force acting across hydraulic surface 100 to overcome the biasing force of spring 88, thereby moving needle valve element 58 toward the orifice-opening position.

To close orifices 84 and end the injection of fuel into combustion chamber 22, second solenoid actuator 62 may be energized. In particular, as the valve element associated with second solenoid actuator 62 is urged toward the flow blocking position, fluid from control chamber 72 may be prevented from draining to tank 28. Because pressurized fluid is continuously supplied to control chamber 72 via restricted supply passageway 80, pressure may rapidly build within control chamber 72 when drainage through control passageway 76 is prevented. The increasing pressure within control chamber 72, combined with the biasing force of spring 88, may overcome the opposing force acting on hydraulic surface 100 to force needle valve element 58 toward the closed position. It is contemplated that second solenoid actuator 62 may be omitted, if desired, and first solenoid actuator 60 used to initiate both the opening and closing motions of needle valve element 58.

Pressure control device 102 may affect pressure of the fuel supplied to central bores 70 and 82, and injected into combustion chamber 22. Specifically, in response to a current applied to the piezo electric crystals of actuator 104, actuator 104 may affect movement of valve elements 106 (referring to FIG. 2) and 108 (referring to FIG. 3) to increase or decrease the amount of pressurized fuel flowing from second common rail 37 into fuel injector 32. With regard to the embodiment of FIG. 2, the movement of actuator 104 may also simultaneously control the amount of pressurized fuel flowing from first common rail 34 into fuel injector 32. In contrast, with regard to the embodiment of FIG. 3, valve element 110 may be independently controlled to vary the flow rate of fuel from first common rail 34 into fuel injector 32.

This change in the flow rates of fuel from first and second common rails 34, 37 may directly affect the pressure of fuel within central bores 70 and 82. For example, an increased current applied to actuator 104 may cause an increase in the flow rate of pressurized fuel from second common rail 37 and a resulting higher pressure of fuel within central bores 70 and 82. In contrast, a decreased current applied to actuator 104 may cause a decrease in the flow rate of pressurized fuel from second common rail 37 and a resulting lower pressure of fuel within central bores 70 and 82. With regard to FIG. 2, the changes in flow rate of pressurized fuel from second common rail 37 may simultaneously correspond to an inverse change in flow rate of pressurized fuel from first common rail 34. With regard to FIG. 3, the flow rate of pressurized fuel from first common rail 34 may be independently controlled via solenoid-actuated valve element 110.

The pressure of the fuel supplied to central bores 70 and 82, and injected into combustion chamber 22 may be varied throughout a single injection cycle (e.g., the cycle of injections occurring during the four strokes of piston 18) or even during a single injection event. Specifically, as illustrated in FIG. 4, a first curve 112 may represent the proportional motion of valve element 106 within a single injection cycle. A second curve 114 may represent various injection events during the injection cycle. A third curve 116 may represent the pressure of fuel injected during a series of injection events within the injection cycle. As can be seen from first and second curves 114, 116, two pilot injections of fuel at a first pressure are illustrated as occurring before piston 18 has reached top dead center (TDC), two main injections of fuel at a second pressure are illustrated as occurring shortly after piston 18 has reached TDC, and one post injection of fuel at a third pressure is illustrated as occurring late in the downward stroke of piston 18.

By comparing first curve 112 and third curve 116, it can be seen that the movement of valve element 106 or 108 may affect the pressure of the individual injection events. Specifically, when valve element 106 or 108 is in the first position, the pressure of the injection event is the same as the pressure of the first flow of fuel from fuel pumping mechanisms 30*a* (e.g., about 100 MPa). When valve element 106 or 108 is in the second position, the pressure of the injection event is the same as the pressure of the second flow of fuel from second pumping mechanisms 30*b* (e.g., about 200 MPa). When valve element 106 or 108 is at a position between the first and second positions, the pressure of the injection event is at a combined pressure level (e.g., between 100 and 200 MPa). A dashed line 118 associated with third curve 116 illustrates the affect of the speed of valve element 106 moving between the first and second positions. It is to be noted that the injection events depicted within FIG. 3 are exemplary only and that any number of injections may be implemented at any suitable timing relative to the motion of piston 18. It is also contemplated that the relative pressure magnitudes depicted by second curve 114 may be modified, as desired.

Because fuel system 12 may vary the pressure of injected fuel by proportionally combining two different flows of pressurized fuel, the number of different levels of fuel pressure available for injection may be infinite. In particular, fuel system 12 is not limited to specific predetermined pressure levels. This flexibility in the pressure of injected fuel may extend the use of fuel system 12 to different applications, as well as extending the operational range and efficiency of engine 10. In addition, this flexibility may allow compliance with emission standards under a wider range of operating conditions.

Further, because fuel system 12 may vary the pressure of injected fuel with a minimal number of additional components, the complexity and cost of fuel system 12 may be low. Specifically, the addition of pressure control device 102 may add very little complexity or cost to fuel system 12.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the invention being indicated by the following claims and their equivalents.

What is claimed is:

1. A fuel system for an engine having at least one combustion chamber, comprising:

a fuel injector;

a first source of fuel at a first pressure;

a second source of fuel at a second pressure; and a pressure control device including a proportional valve element disposed between the fuel injector and the first and second sources, the pressure control device configured to selectively direct the fuel at the first pressure and the fuel at the second pressure to the fuel injector for injection into the at least one combustion chamber.

2. The fuel system of claim 1, wherein the pressure control device is further configured to:

selectively combine the fuel at the first pressure with the fuel at the second pressure; and selectively direct the combined fuel to the fuel injector.

3. The fuel system of claim 1, wherein the proportional valve element is disposed in communication with the first and second sources.

4. The fuel system of claim 3, wherein the proportional valve element is movable between a first position at which only the fuel at the first pressure is directed to the fuel injector, and a second position at which only the fuel at the second pressure is directed to the fuel injector.

5. The fuel system of claim 4, wherein the second pressure is about two times the first pressure.

6. The fuel system of claim 5, wherein the proportional valve element is spring biased toward the first position.

7. The fuel system of claim 1, wherein the proportional valve element is in communication with the second source; and the pressure control device further includes a second valve element in communication with the first source.

8. The fuel system of claim 7, wherein the proportional valve element is movable between a first position at which pressurized fuel from the second source is directed to the fuel injector, and a second position at which pressurized fuel from the second source is blocked from the fuel injector.

9. The fuel system of claim 8, wherein the second valve element is a two-position valve element movable from a first position at which pressurized fuel from the first source is directed to the fuel injector, to a second position at which pressurized fuel from the first source is blocked from the fuel injector.

10. The fuel system of claim 1, wherein the pressure control device includes a piezo actuator.

11. A method of injecting fuel into a combustion chamber of an engine, the method comprising:

pressurizing fuel to a first pressure;

pressurizing fuel to a second pressure; and actuating a proportional valve element to selectively combine fuel at the first pressure and fuel at the second pressure to selectively direct fuel at a third pressure to a fuel injector for injection into the combustion chamber.

12. The method of claim 11, wherein the second pressure is about two times the first pressure.

13. The method of claim 12, further including:

injecting fuel into the combustion chamber at the first pressure during a pilot injection event; and injecting fuel into the combustion chamber at the second pressure during a main injection event.

14. The method of claim 13, further including injecting fuel into the combustion chamber at the third pressure during a post injection event, wherein the third pressure is greater than the first pressure, but less than the second pressure.

15. An engine having at least one combustion chamber, the engine comprising:

a fuel injector configured to inject fuel into the at least one combustion chamber;

a first source of fuel at a first pressure;

a second source of fuel at a second pressure; and a pressure control device including a proportional valve element disposed between the fuel injector and the first and second sources, the pressure control device configured to selectively direct the fuel at the first pressure and the fuel at the second pressure to the fuel injector for injection into the at least one combustion chamber.

16. The engine of claim 15, wherein the pressure control device is further configured to:

selectively combine the fuel at the first pressure with the fuel at the second pressure; and selectively direct the combined fuel to the fuel injector.

17. The engine of claim 15, wherein:

the proportional valve element is disposed in communication with the first and second sources; and the proportional valve element is movable between a first position at which only the fuel at the first pressure is directed to the fuel injector, and a second position at which only the fuel at the second pressure is directed to the fuel injector.

18. The engine of claim 17, wherein:

the second pressure is about two times the first pressure; and the proportional valve element is spring biased toward the first position.

19. The engine of claim 15, wherein:

the proportional valve element is in communication with the second source;

the pressure control device further includes a second valve element in communication with the first source;

the proportional valve element is movable between a first position at which pressurized fuel from the second source is directed to the fuel injector, and a second position at which pressurized fuel from the second source is blocked from the fuel injector; and the second valve element is a two-position valve element movable from a first position at which pressurized fuel from the first source is directed to the fuel injector, to a second position at which pressurized fuel from the first source is blocked from the fuel injector.

20. The engine of claim 15, wherein the pressure control device includes a piezo actuator.

21. The method of claim 14, wherein the third pressure is between 100 and 200 MPa.

* * * * *